United States Patent [19]

Giraudi

[11] Patent Number: 4,575,009

[45] Date of Patent: Mar. 11, 1986

[54] ELECTRICALLY OPERATED INJECTOR FOR AN I.C. ENGINE

[75] Inventor: Walter Giraudi, Milan, Italy

[73] Assignee: Alfa Romeo Auto S.p.A., Naples, Italy

[21] Appl. No.: 469,708

[22] Filed: Feb. 25, 1983

[30] Foreign Application Priority Data

Aug. 18, 1982 [IT] Italy ..... 22885 A/82

[51] Int. Cl.[4] ..... B05B 1/30

[52] U.S. Cl. ..... 239/585; 251/129.21

[58] Field of Search ..... 239/585; 251/129.21

[56] References Cited

U.S. PATENT DOCUMENTS

| | | | |
|---|---|---|---|
| 4,245,789 | 1/1981 | Gray | 239/585 |
| 4,310,123 | 1/1982 | TePastte | 239/585 |
| 4,339,082 | 7/1982 | Radaelli et al. | 239/585 |
| 4,360,164 | 11/1982 | Bellicardi et al. | 239/585 |

*Primary Examiner*—Andres Kashnikow
*Assistant Examiner*—Daniel R. Edelbrock
*Attorney, Agent, or Firm*—Charles E. Brown; Charles A. Brown

[57] ABSTRACT

An electrically operated injector provided with a mobile cup-shaped armature which acts as the closure element for the injection nozzle and is guided internally by a tubular element which also acts as a stop for the armature lifting stroke. The armature also has a base wall provided with bores with skew-inclined axes for feeding fuel to the injection nozzle.

2 Claims, 3 Drawing Figures

ELECTRICALLY OPERATED INJECTOR FOR AN I.C. ENGINE

This invention relates to an electrically operated injector particularly suitable for intermittent fuel delivery to the intake manifold of an I.C. engine in response to an electrical control signal provided by an apparatus for controlling the injection delivery and timing.

Generally, electrically operated injectors for I.C. engines are provided with a mobile armature which on being lifted opens the closure element of the fuel injection nozzle, the fuel delivery for equal nozzle cross-sections depending essentially on the time for which the closure element is open, because the lifting stroke of the armature is fixed, and the fuel pressure drop in passing through the nozzle is maintained substantially constant.

As the fuel delivered is a function of the engine rotational speed and loading, and varies approximately as 1 to 10 in passing from idling to full power running, the response time of the closure element must be as rapid as possible and constant with time with respect to the control signal in order to attain accurate metering of the fuel delivered by an electrically operated injector, even for low deliveries.

Consequently, the time of opening of the closure element will coincide more with the control signal the more the opening and closure transients are short and stable with time.

The duration of the transients depends on numerous factors, but in particular on the mass and dimensions of the mobile armature and closure element, and on the extent of the friction which can act on the closure element during the opening and closure strokes of the injection nozzle. Other determining factors for the duration of the transients include the reluctance of the injector coil and its consequent capacity for energisation and de-energisation more or less rapidly, the reluctance of the magnetic circuit of which the mobile armature forms part, and the resistance of the hydraulic circuit which conveys the fuel inside the injector towards the injection nozzle.

The object of the present invention is an electrically operated injector in which the various parameters influencing the duration of the transients are improved, and in particular the design of the magnetic circuit and hydraulic circuit of said electrically operated injector is optimised.

Specifically, the present invention relates to an electrically operated injector provided with a core of ferromagnetic material, a coil surrounding the core, an injection nozzle, a mobile cup-shaped armature acting also as the closure element and disposed between the core and injection nozzle and coaxial with both, a return spring which urges the armature against the injection nozzle, and a tubular element projecting from the interior of the core to act as an internal guide for the armature and as a duct for conveying the fuel to the injection nozzle.

Electrically operated injectors of this type, such as that described in the U.S. patent application Ser. No. 173.326 filed on July 29, 1980, now U.S. Pat. No. 4,339,082, have as their main advantages the low weight and small overall size of the mobile element constituted by the cup-shaped armature, very low friction as a consequence of the internal guiding of the armature, and low magnetic circuit reluctance.

During our research it has been found that such injectors could be further improved with regard to their operation by making special modifications to their magnetic and hydraulic circuits.

According to the present invention, the tubular element which acts as the internal guide for the mobile armature also acts as the stop for the lifting stroke of said armature, as its lower annular wall is spaced apart from the inner surface of the base wall of the armature by a distance equal to said lifting stroke.

With this design, an air gap exists between the core and armature even when the armature is completely lifted, this having considerable transient reduction advantages over electrically operated injectors of the same type in which the coil core acts as the armature stop.

According to a further characteristic of the invention, the mobile cup-shaped armature has its base wall provided with peripheral through bores with their axes skew-inclined, for feeding fuel to the injection nozzle.

A very linear fuel flow is thus set up inside the injector, which reduces pressure drops upstream of the injection nozzle to a minimum.

Characteristics and advantages of the invention will be more apparent from FIGS. 1 and 2 which show a preferred embodiment of the electrically operated injector according to the invention, by way of non-limiting example.

Figure 1:
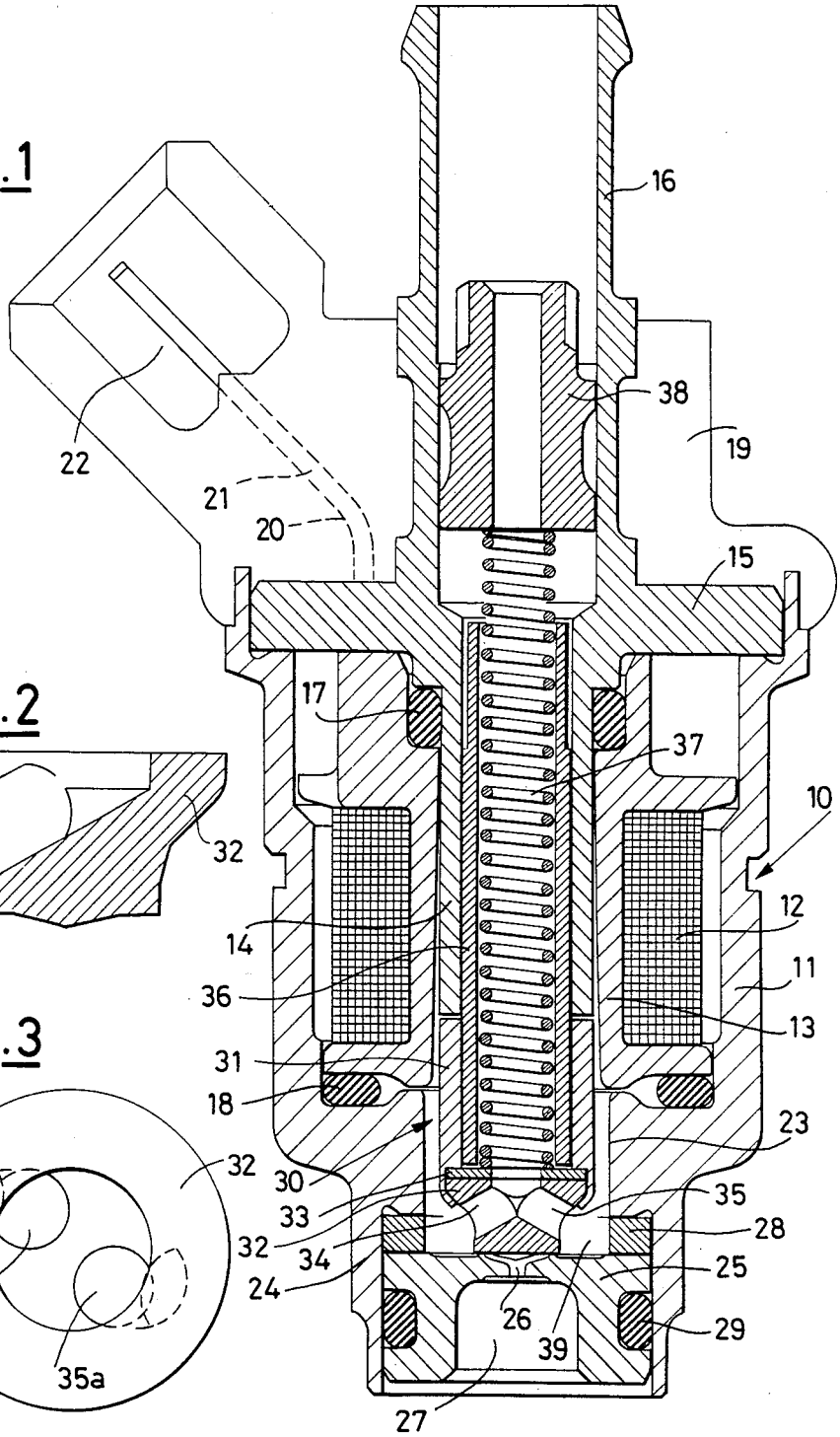
FIG. 1 is a section on the longitudinal axis of the injector.

In FIG. 1, the reference numeral 10 indicates overall an electrically operated injector comprising an outer casing 11, a coil 12 wound on a spool 13, and a core of ferromagnetic material 14. The core 14 is connected to a plate 15 which upperly closes the injector 10, and to a tube 16 which is connected to the fuel feed pipe.

A seal ring 17 is disposed between the spool 13 and core 14, and a seal ring 18 is disposed between the spool 13 and casing 11.

A plastic cap 19 is mounted on the tube 16 and on the upper part of the casing 11, and is provided with a channel 20 from which the conductor 21 of the coil 12 emerges for connection to the terminal 22 in order to receive the energising current from the injection control apparatus, not shown.

Lowerly, the casing 11 comprises an inner annular pole piece 23, and below this a tubular nose 24 which is inserted into the corresponding seat of the intake duct, not shown, of an internal combustion engine.

Inside the tubular nose 24 is disposed a block 25 comprising the fuel injection nozzle 26 and a cavity 27 into which the fuel jet delivered by said nozzle 26 flows.

The block 25 is inserted into the tubular nose 24 by way of a spacer 28 and a seal ring 29.

A mobile cup-shaped armature 30 is disposed between the core 14 and nozzle 26. The armature 30 is provided with a cylindrical side wall 31 constructed of a material permeable to the flow of magnetic induction, for example Permenorm 5000, and a base wall 32 constructed of a seal material, for example Delrin. A washer 33 of impact-resistant material is inserted between the walls 31 and 32 of the armature.

Figure 2:
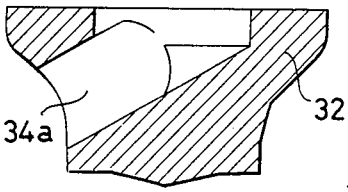
FIGS. 2 and 3 show a modification of a detail of FIG. 1.
Figure 3:
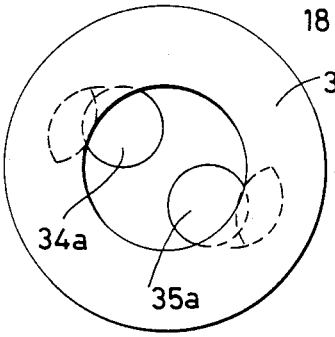

The base wall 32 of the armature is provided with peripheral through bores 34, 35 which can have their axes skew and inclined to the longitudinal axis of the injector, such as those indicated by **34*a* and 35*a* in the modified embodiment of FIGS. 2 and 3**.

A tubular element 36 is interference-fitted into the core 14, and internally guides the armature 30 to keep it coaxial to said core and to the nozzle 26.

The tubular element 36 is constructed of AISI 300, with its outer surface lapped in order to reduce friction losses to a minimum during the armature movement.

The distance between the lower annular wall of the element 36 and the upper wall of the washer 33 is equal to the stroke of the armature 30.

A preloaded return spring 37 is disposed inside the tubular element 36 to urge the armature 30 downwards in order to close the nozzle 26. The spring 37 is preloaded by means of a bored adjustment pin 38 inserted into the fuel feed tube 16.

The pressurised fuel reaching the tube 16 passes into the tubular element 36, then through the bores 34, 35 in the base wall of the armature 30, to reach the chamber 39, which feeds the nozzle 26 when the armature is lifted.

The signals for controlling the delivery of the electrically operated injector are fed cyclically to the coil 12 in the form of current pulses of substantially rectangular wave form, emitted by an injection delivery and timing control apparatus. For example, each current pulse can comprise an initial peak followed by a step of reduced value.

The current pulses, the duration of which varies with the quantity of petrol required by the engine under the various operating conditions, energise the coil 12 to generate a magnetomotive force and a magnetic induction flow in the circuit comprising the pole piece 23, the armature 30 and the core 14.

The armature 30 is lifted by the induced polarisation effect against the action of the spring 37, to move through a stroke which is limited by the washer 33 striking against the lower wall of the tubular element 36. The armature 30 remains lifted for the duration of the current pulse, to enable a jet of pressurised fuel to be delivered by the nozzle 26 into the cavity 27.

On cessation of the current pulse, the armature 30 is lowered under the action of the spring 37, to close the nozzle 26 and interrupt fuel delivery.

In the described injector, the armature 30 on being lifted strikes against the tubular guide element 36, whereas an air gap, i.e. a permanent discontinuity, remains between the core 14 and armature 30. This leads to a reduction in the magnetic force which keeps the armature completely lifted, this force increasing as the distance between the core and armature decreases, and being a maximum for zero distance.

The consequence is a considerable reduction and a greater stabilisation of the closure transient of the armature 30, because the magnetic force falls off very rapidly, being lower. Identical advantages are obtained for the armature opening transient, because the preloading of the return spring 37 can be considerably reduced, in order to operate with energising pulses for the coil 12 which have a lower initial current peak.

With the described design it is also possible to reduce the end-of-stroke contact area of the armature, because contact is made with the tubular element 36 and not the core 14, on the cross-section of which the reluctance of the magnetic circuit depends.

The result is a smaller pumping section for the fuel which, during the armature lifting and lowering strokes, is drawn in and expelled between said armature and the tubular element, with the consequent advantage of greater injector insensitivity to fuel viscosity variations.

In addition, the arrangement of inclined bores 34, 35 in the base wall of the armature 30 for feeding the chamber 39 improves fuel flow through the injector by the absence of sudden direction variations and constrictions, which would lead to pressure drops upstream of the nozzle 26.

A further advantage of the arrangement of the bores **34*a* and 35*a* with skew-inclined axes is an improved atomisation of the fuel jet in the cavity 27 by virtue of the widening of the jet injection cone due to the tangential velocity components in the chamber 39 upstream of the nozzle 26**.

I claim:

1. An electrically operated injector of the type particularly constructed for the intermittent delivery of fuel to an I.C. engine, said injector including a core of ferromagnetic material, a coil surrounding said core, an injection nozzle, a mobile cup-shaped armature having means for acting as a closure element for said injection nozzle and disposed between said core and said injection nozzle, said armature being coaxial with both said core and said injection nozzle, said armature having a base wall and a side wall, a return spring urging said armature against said injection nozzle to close said injection nozzle, and a tubular element projecting from the interior of said core and forming an inner guide for said armature and a duct for conveying fuel to said injection nozzle, said injector being characterized in that there is a washer of impact-resistant material disposed between said base wall and said side wall of the armature, said tubular element in combination with said washer also forms stop means for limiting a lifting stroke of said armature, said tubular element lower annular end wall is spaced axially from an upper surface of said washer by a distance equal to a selected lifting stroke of said armature.

2. An electrically operated injector as claimed in claim 1, characterised in that the mobile armature has its base wall provided with peripheral through bores with their axes skew-inclined, for feeding fuel to the injection nozzle.

* * * * *